US010537931B2

(12) United States Patent
Ooyama et al.

(10) Patent No.: US 10,537,931 B2
(45) Date of Patent: Jan. 21, 2020

(54) HEATING METHOD, HEATING APPARATUS AND METHOD FOR MANUFACTURING PRESS-MOLDED ARTICLE

(71) Applicant: NETUREN CO., LTD., Tokyo (JP)

(72) Inventors: Hironori Ooyama, Tokyo (JP); Fumiaki Ikuta, Tokyo (JP)

(73) Assignee: NETUREN CO., LTD, Tokyo (JP)

( * ) Notice: Subject to any disclaimer, the term of this patent is extended or adjusted under 35 U.S.C. 154(b) by 324 days.

(21) Appl. No.: 15/548,848

(22) PCT Filed: Mar. 2, 2016

(86) PCT No.: PCT/JP2016/001141
§ 371 (c)(1),
(2) Date: Aug. 4, 2017

(87) PCT Pub. No.: WO2016/139944
PCT Pub. Date: Sep. 9, 2016

(65) Prior Publication Data

US 2018/0029103 A1 Feb. 1, 2018

(30) Foreign Application Priority Data

Mar. 5, 2015 (JP) ..... 2015-043557

(51) Int. Cl.
*B21D 37/16* (2006.01)
*H05B 3/00* (2006.01)
(Continued)

(52) U.S. Cl.
CPC ..... *B21D 37/16* (2013.01); *H05B 3/0004* (2013.01); *B21D 22/208* (2013.01); *C21D 1/40* (2013.01); *H05B 3/03* (2013.01)

(58) Field of Classification Search
CPC ..... B21D 37/16; B21D 22/208; H05B 3/03; H05B 3/023; H05B 3/004; C21D 1/40
(Continued)

(56) References Cited

U.S. PATENT DOCUMENTS 9,907,118 B2 * 2/2018 Ooyama ..... H05B 3/03
2010/0285328 A1 11/2010 Nonomura et al.
(Continued)

FOREIGN PATENT DOCUMENTS

JP 3587501 11/2004
JP 2013-114942 6/2013
(Continued)

OTHER PUBLICATIONS

International Search Report and Written Opinion of the International Searching Authority, dated Jun. 16, 2016, in corresponding International Application No. PCT/JP2016/001141.

*Primary Examiner* — David B Jones
(74) *Attorney, Agent, or Firm* — Wenderoth, Lind & Ponack, L.L.P.

(57) ABSTRACT

A heating method, a heating apparatus, and a method for manufacturing a press-molded article using the heating method are provided. Electrodes are placed on a workplace to extend across a heating target region in a first direction. At least one of the electrodes is moved in a second direction perpendicular to the first direction over the heating target region while applying electric current to the electrodes. A distribution of contact pressure between at least one of the electrodes and the workpiece along the first direction is adjusted, with a plurality of segment regions being defined by dividing the heating target region such that the segment regions are arranged side by side in the first direction, and in accordance with a length of each of the segment regions
(Continued)

between the electrodes, to adjust a healing temperature of each of the segment regions of the heating target region.

10 Claims, 7 Drawing Sheets

(51) Int. Cl.
*C21D 1/40* (2006.01)
*H05B 3/03* (2006.01)
*B21D 22/20* (2006.01)

(58) Field of Classification Search
USPC ..... 72/342.96
See application file for complete search history.

(56) References Cited

U.S. PATENT DOCUMENTS

| | | | | |
|---|---|---|---|---|
| 2014/0209597 | A1 | 7/2014 | Matsumoto | |
| 2014/0339210 | A1 | 11/2014 | Kobayashi et al. | |
| 2015/0173126 | A1 | 6/2015 | Ooyama et al. | |
| 2015/0208466 | A1* | 7/2015 | Ooyama ..... | C21D 9/0012 219/162 |
| 2017/0314094 | A1* | 11/2017 | Ooyama ..... | C21D 9/0068 |
| 2018/0029103 | A1* | 2/2018 | Ooyama ..... | H05B 3/0004 |

FOREIGN PATENT DOCUMENTS

| | | |
|---|---|---|
| WO | 2009/138869 | 11/2009 |
| WO | 2013/081180 | 6/2013 |
| WO | 2013/180313 | 12/2013 |

* cited by examiner

HEATING METHOD, HEATING APPARATUS AND METHOD FOR MANUFACTURING PRESS-MOLDED ARTICLE

TECHNICAL FIELD

The present invention relates to a heating method and a heating apparatus for heating a plate workpiece by a direct resistance heating, and a method for manufacturing a press-molded article.

BACKGROUND ART

Methods for heating steel workpieces include indirect heating and direct heating. The indirect heating includes, for example, a furnace heating. The direct heating includes, for example, an induction heating and a direct resistance heating. In the induction heating, eddy current is applied to a workpiece by electromagnetic induction to heat the workpiece. In the direct resistance heating, electric current is applied directly to a workpiece to heat the workpiece.

According to a first related art heating method, a plate workpiece having a heating target region whose width varies along a longitudinal direction of the workpiece is heated by a direct resistance heating. The heating target region is divided into a plurality of strip-shaped segment regions arranged side by side in the longitudinal direction of the workpiece. A pair of electrodes is provided for each segment region. Electric current is applied to each pair of electrodes so that the heating target region is heated uniformly (see, e.g., JP3587501B2).

Also according to a second related art heating method, a plate workpiece having a heating target region whose width varies along a longitudinal direction of the workpiece is heated by a direct resistance heating. The heating target region of the workpiece has a width decreasing monotonously from one end toward the other end in the longitudinal direction. A pair of electrodes is placed on the wide end portion of the heating target region of the workpiece, and one of the electrodes is moved toward the narrow end portion while applying electric current to the pair of electrodes so that the heating target region is heated uniformly (see, e.g., JP2013-114942A).

According to the first related art healing method, a configuration of a heating apparatus is complicated because multiple pairs of electrodes are required for one heating target region. On the other hand, according to the second related art healing method, a heating target region can be heated uniformly by a single pair of electrodes. Thus, the configuration of the heating apparatus can be simplified.

However, when the heating target region whose width varies along its longitudinal direction is divided into a plurality of strip-shaped segment regions such that the segment regions are arranged side by side in the width direction of the heating target region, the lengths of the segment regions between the pair of electrodes are different from one another, and resistances of the segment regions are also different from one another. Electric current flowing through a segment region having a relatively long length between the pair of electrodes, that is, having relatively large resistance, is relatively small. Thus, the amount of heat generated in the segment region is relatively small. Therefore, in the second related art heating method, the temperature distribution along the width direction of the heating target region may not be uniform.

SUMMARY

Illustrative aspects of the present invention provide a heating method and a heating apparatus capable of uniformly heating a heating target region of a workpiece and also capable of providing a desired temperature distribution on the heating target region of the workpiece.

According to an illustrative aspect of the present invention, a heating method includes placing a pair of electrodes on a workpiece along a first direction, the pair of electrodes having a length extending across a heating target region of the workpiece in the first direction, moving at least one of the electrodes in a second direction perpendicular to the first direction over the heating target region while applying electric current to the pair of electrodes, to heat the heating target region by a direct resistance heating, and adjusting a distribution of contact pressure between at least one of the electrodes and the workpiece along the first direction, with a plurality of segment regions being defined by dividing the heating target region such that the segment regions are arranged side by side in the first direction, and in accordance with a length of each of the segment regions between the pair of electrodes, to adjust a heating temperature of each of the segment regions of the heating target region.

According to another illustrative aspect of the present invention, a heating apparatus includes pair of electrodes arranged to extend across a heating target region of a workpiece in a first direction, a power supply unit configured to supply electric current to the pair of electrodes, a moving section configured to move at least one of the electrodes in a second direction perpendicular to the first direction over the heating target region, a presser configured to press at least one of the electrodes against the workpiece such that a distribution of contact pressure against the workpiece along the first direction is adjustable, and a control unit configured to control the presser, with a plurality of segment regions being defined by dividing the heating target region such that the segment regions are arranged side by side in the first direction, and in accordance with a length of each of the segment regions between the pair of electrodes, to adjust the distribution of the contact pressure along the first direction.

According to another illustrative aspect of the present invention, a method for manufacturing a press-molded article is provided. The method includes heating a plate workpiece by the heating method described above, and applying pressure to the plate workpiece with a press mold to perform hot press molding on the plate workpiece.

Other aspects and advantages of the invention will be apparent from the following description, the drawings and the claims.

DESCRIPTION OF EMBODIMENTS

Hereinafter, embodiments of the present invention will be described in detail with reference to the drawings.

Figure 1A:
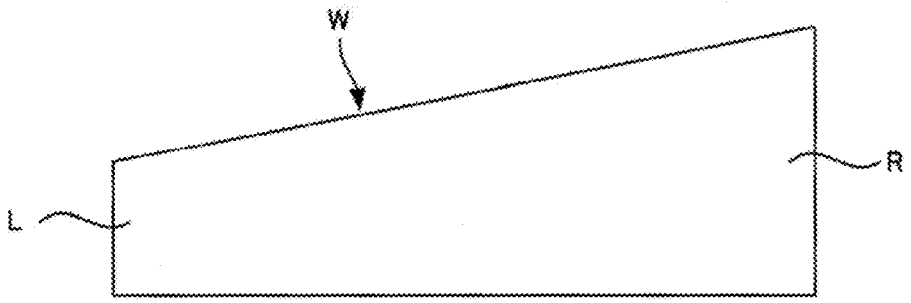
FIG. 1A is a plan view of an example of a workpiece to be heated according to an embodiment of the present invention.
Figure 1B:
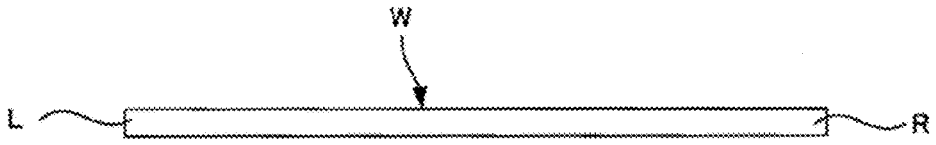
FIG. 1B is a front view of the workpiece of FIG. 1A.

FIGS. 1A and 1B illustrate an example of a workpiece W according to an embodiment of the present invention. The workpiece W shown is a strip material with a constant thickness. The dimension of the workpiece W in a width direction (first direction) thereof decreases monotonously from one end R toward the other end L along the longitudinal direction (second direction) of the workpiece W. In this example, the entire workpiece W is a heating target region.

Figure 2A:
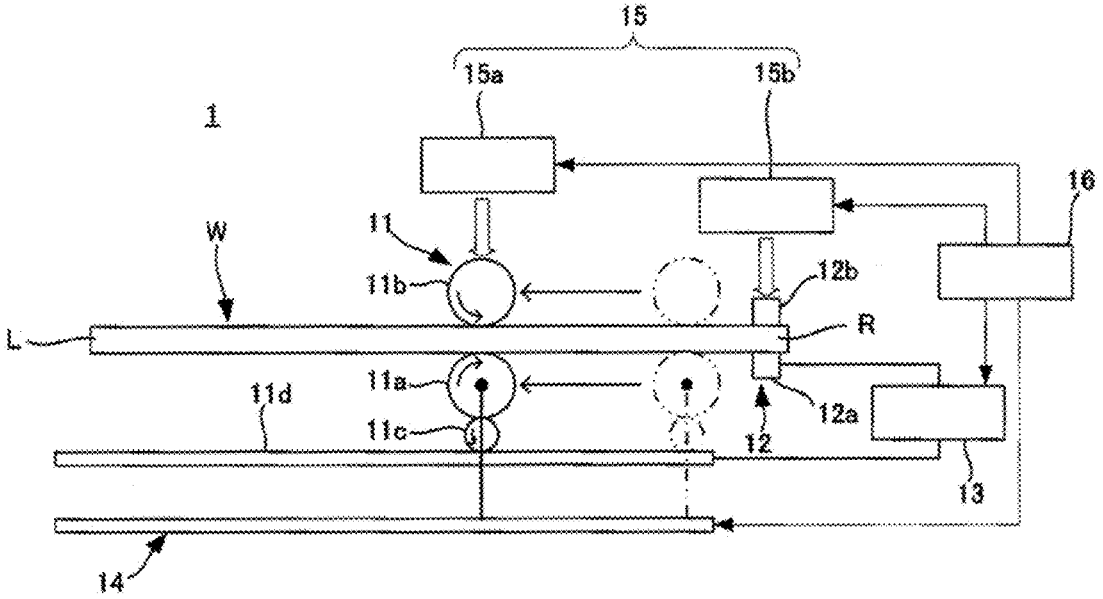
FIG. 2A is a front view of an example of a heating apparatus according to an embodiment of the present invention.
Figure 2B:
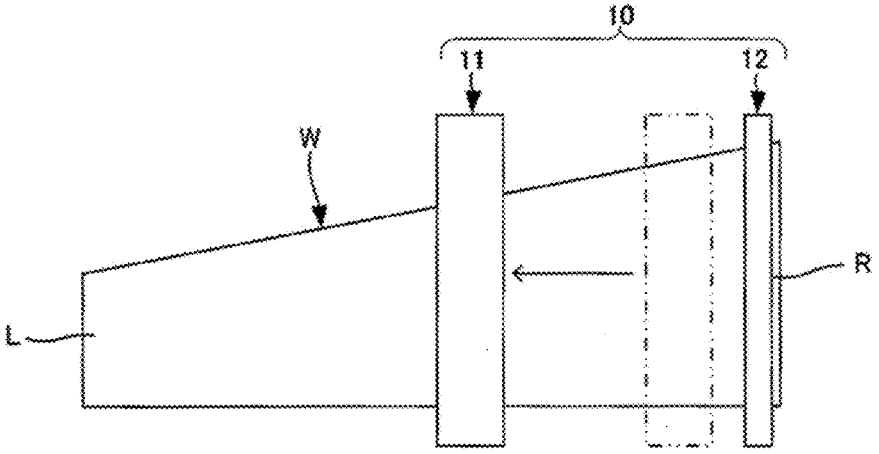
FIG. 2B is a plan view illustrating a pair of electrodes of the heating apparatus together with the workpiece.
Figure 2C:
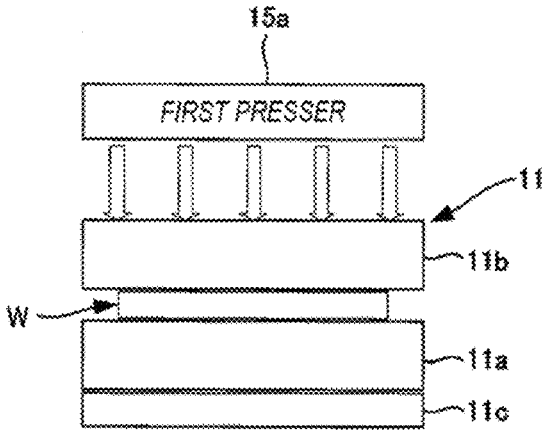
FIG. 2C is a side of the heating apparatus.

FIGS. 2A to 2C illustrate an example of a heating apparatus configured to heat the workpiece W.

A heating apparatus 1 has a pair of electrodes 10 including electrodes 11, 12, a power supply unit 13, a moving section 14, a presser 15, and a control unit 16.

The electrodes 11, 12 forming the pair of electrodes 10 are disposed across the workpiece W (heating target region) in its width direction thereof. In this example, the electrode 11 is supported by the moving section 14 so as to be movable in the longitudinal direction of the workpiece W, while the electrode 12 is disposed at the wide end portion R of the workpiece W and is fixed in place. Alternatively, the electrode 12 may also be supported by a moving section 14 so as to be movable in the longitudinal direction of the workpiece W.

The movable electrode 11 includes a main electrode portion 11*a* and an auxiliary electrode portion 11*b* holding the workpiece W in the thickness direction thereof. The fixed electrode 12 to be fixed on the workpiece W also includes a main electrode portion 12*a* and an auxiliary electrode portion 12*b* holding the workpiece W in the thickness direction thereof. The main electrode portion 11*a* and the auxiliary electrode portion 11*b* of the movable electrode 11 are configured as rollers respectively. When the movable electrode 11 is moved by the moving section 14, the main electrode portion 11*a* and the auxiliary electrode portion 11*b* roll on the surface of the workpiece W while contacting the workpiece W.

The main electrode portion 11*a* of the movable electrode 11 rolls on a bus bar 11*d* through an auxiliary roller 11*c*. The bus bar 11*d* extends in the longitudinal direction of the workpiece W. The bus bar 11*d* is connected to the power supply unit 13. An electric current is supplied from the power supply unit 13 to the main electrode portion 11*a* through the bus bar 11*d* and the auxiliary roller 11*c*. The main electrode portion 11*a* and the auxiliary electrode portion 11*b* may be electrically connected, to each other so that the electric current can be supplied to the main electrode portion 11*a* and the auxiliary electrode portion 11*b*.

The presser 15 is configured to adjust the distribution of width-direction contact pressure between at least one of the pair of electrodes 10 and the workpiece W. In the illustrated example, the presser 15 includes a first presser 15*a* configured to adjust the distribution of contact pressure between the movable electrode 11 and the workpiece W and a second presser 15*b* configured to adjust the distribution of contact pressure between the fixed electrode 12 and the workpiece W.

The first presser 15*a* includes, for example, a plurality of pressing elements, such as cylinders, provided at intervals along the auxiliary electrode portion 11*b* of the movable electrode 11 and driven independently of one another. A plurality of locations on the auxiliary electrode portion 11*b* are pressed by the respective pressing elements to adjust the distribution of contact pressure between the workpiece W and the movable electrode 11.

The second presser 15*b* may also be configured in the same manner. That is, the second presser 15*b* may include a plurality of pressing elements, such as cylinders, provided at intervals along the auxiliary electrode portion 12*b* of the fixed electrode 12 and driven independently of one another. A plurality of locations on the auxiliary electrode portion 12*b* are pressed by the pressing elements to adjust the distribution of contact pressure between the fixed electrode 12 and the workpiece W.

The power supply unit 13 is configured to supply DC or AC current to the pair of electrodes 10 under the control of the control unit 16. The moving section 14 is configured to move the movable electrode 11 in the longitudinal direction of the workpiece W under the control of the control unit 16. The presser 15 is configured to adjust the distribution of contact pressure between each of the movable electrode 11 and the fixed electrode 12 and the workpiece W under the control of the control unit 16.

Next, a method for heating the workpiece W by a direct resistance heating using the heating apparatus 1 will be described.

Figure 3A:
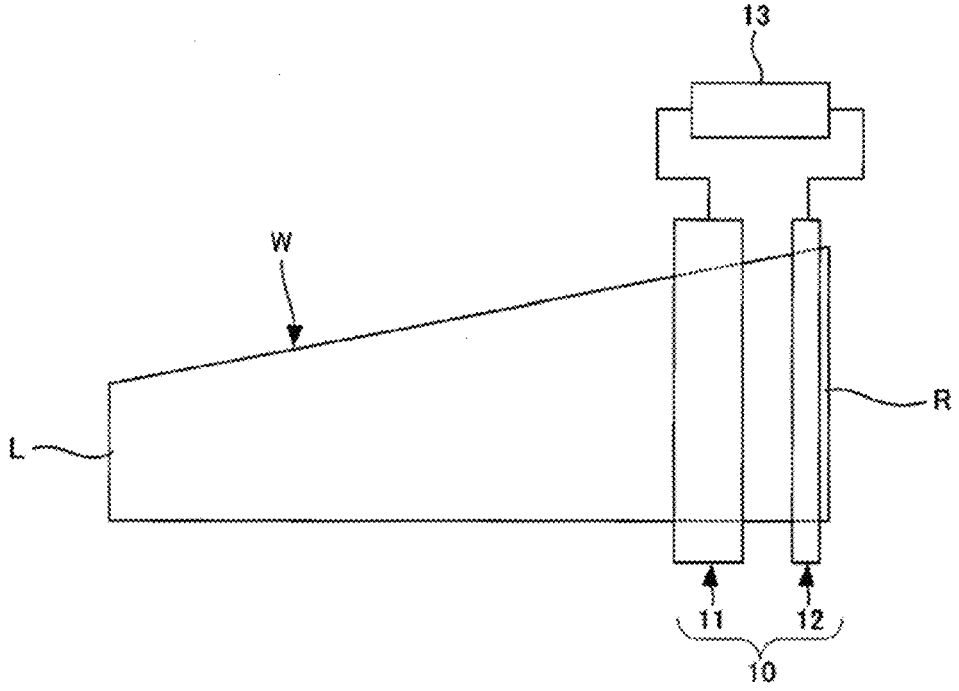
FIG. 3A is a plan view illustrating an example of a direct resistance heating according to an embodiment of the present invention.
Figure 3B:
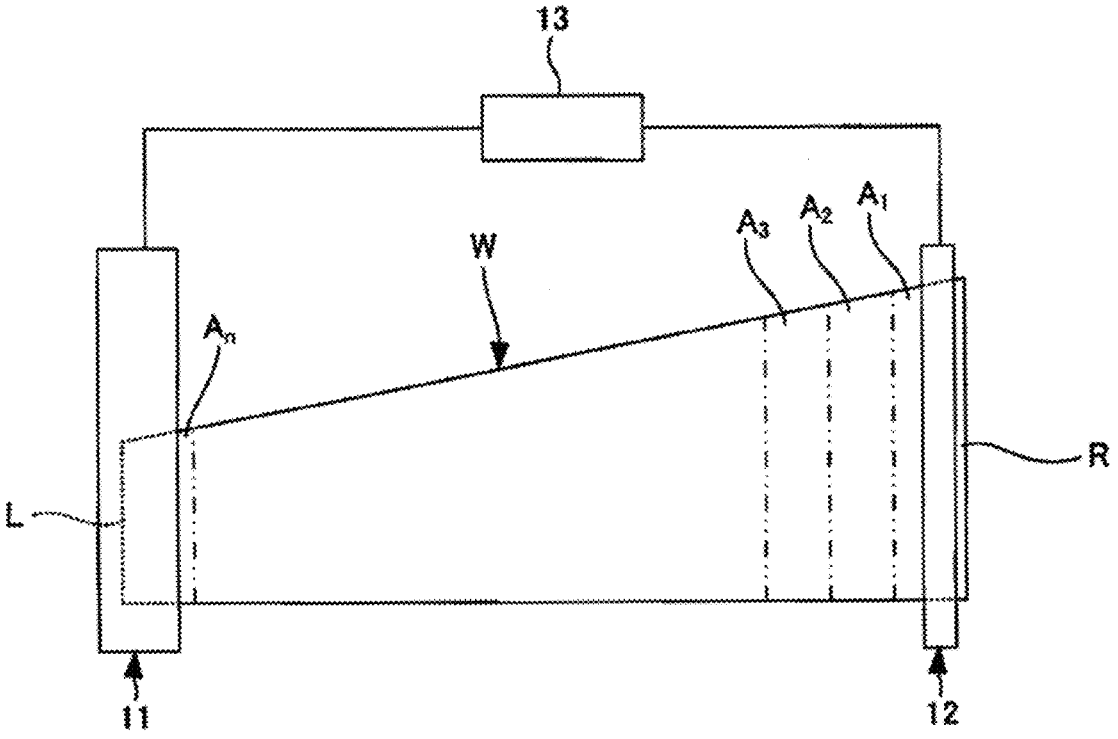
FIG. 3B is another plan view illustrating the direct resistance heating method.

FIGS. 3A and 3B are plan views of an example in which the heating temperature of the workpiece W is controlled in the longitudinal direction of the workpiece W. The movable electrode 11 is disposed in the end portion R of the workpiece W where the fixed electrode 12 is disposed. Then, electric current is applied to the pair of electrodes 10. In that state, the movable electrode 11 is moved from the end portion R of the workpiece W toward the end portion L of the same.

When the movable electrode 11 is being moved from the end portion R of the workpiece W toward the end portion L of the same, the electric current applied between the pair of electrodes 10 and/or the moving speed of the movable electrode 11 are adjusted suitably. Thus, the heating temperature of each segment region $A_i$ (i=1, 2, 3, . . . n) into which the workpiece W is virtually divided in the longitudinal direction thereof can be adjusted individually.

For example, with the workpiece W having a width that monotonously decreases along the moving direction of the movable electrode 11 moving in the longitudinal direction of the workpiece W, in other words, the workpiece W having a cross sectional area that decreases monotonously along the moving direction of the movable electrode 11, i.e., the resistance per unit length of the workpiece W increases monotonously, the workpiece W can be heated uniformly along the longitudinal direction.

Figure 4:
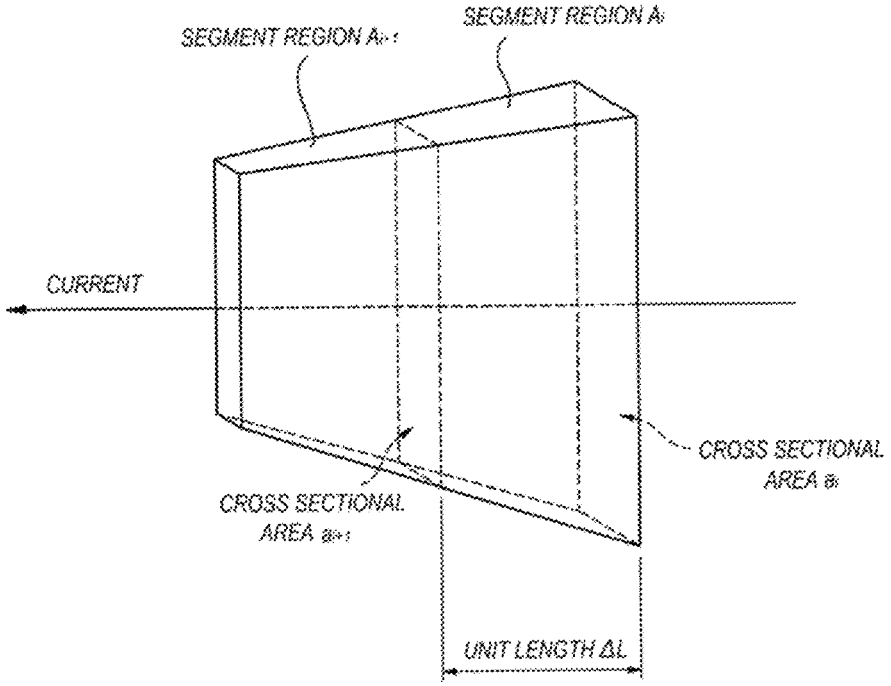
FIG. 4 is a diagram illustrating a concept of an adjustment of electric current applied between the electrodes and an adjustment of a moving speed of a movable electrode according to the direct resistance heating method of FIGS. 3A and 3B.

FIG. 4 shows the concept of adjustment of the electric current applied between the pair of electrodes 10 and adjustment of the moving speed of the movable electrode 11 when the workpiece W is heated uniformly along the longitudinal direction.

With $I_i$ being electric current applied when the movable electrode 11 passes through each segment region A; with a unit length D1, and $t_i$ being a current application time (sec), the temperature (amount of temperature rise) $q_i$ in the segment region $A_i$ can be obtained by the following expression, because the segment region $A_i$ is heated after the movable electrode 11 passes through the segment region $A_i$.

$$\theta_i = \frac{\rho_e}{C\rho}\frac{1}{a_i^2}\sum_{i}^{n}(I_i^2 \times t_i) \quad \text{[Math. 1]}$$

where re is resistivity (Q×m), r is density (kg/m$^3$), c is specific heat (J/kg×° C.), and $a_i$ is the cross sectional area (m$^2$) of the segment region Ai.

The temperature $q_i$ in each segment region $A_i$ can be made uniform as $q_1=q_2= \ldots =q_n$ if the applied current $I_i$ or the current application time $t_i$ (electrode moving speed $V_i$) for each segment region $A_i$ is adjusted to satisfy the following expression. When the speed is constant, only the applied current $I_i$ may be adjusted because the current application time $t_i$ is constant. When the current is constant, only the current application time $t_i$ may be adjusted because the applied current $I_i$ is constant. Both the applied current $I_i$ and the current application time $t_i$ may be adjusted.

$$\frac{1}{a_1^2}\sum_{i=1}^{n}(I_i^2 \times t_i) = \frac{1}{a_2^2}\sum_{i=2}^{n}(I_i^2 \times t_i) = \ldots = \frac{1}{a_n^2}\sum_{i=n}^{n}(I_i^2 \times t_i) \quad \text{[Math. 2]}$$

When the fixed electrode 12 is fixed to the end portion R of the workpiece W and the movable electrode 11 is moved from the end portion R of the workpiece W toward the end portion L of the same, a current application section put between the movable electrode 11 and the fixed electrode 12 in the workpiece W is expanded gradually from the end portion R side where the resistance per unit length in the moving direction of the movable electrode 11 is relatively small.

Accordingly, the current application time t1 differs from one segment region Ai to another. The current application time is longer in a segment region closer to the end portion R. When the same current is applied to a segment region on the end portion R side and a segment region on the end portion L side for the same time, the amount of heat is smaller in the segment region on the end portion R side where the resistance per unit length in the moving direction of the movable electrode 11 is relatively small.

Therefore, based on the variation in resistance per unit length in the moving direction of the movable electrode 11, the electric current applied between the pair of electrodes 10 and/or the moving speed of the movable electrode 11 are adjusted in accordance with the relationship to the current application time ti for each segment region Ai, so as to adjust the amount of heat generated in the segment region Ai. In this manner, the workpiece W can be heated uniformly m the longitudinal direction.

Figure 5:
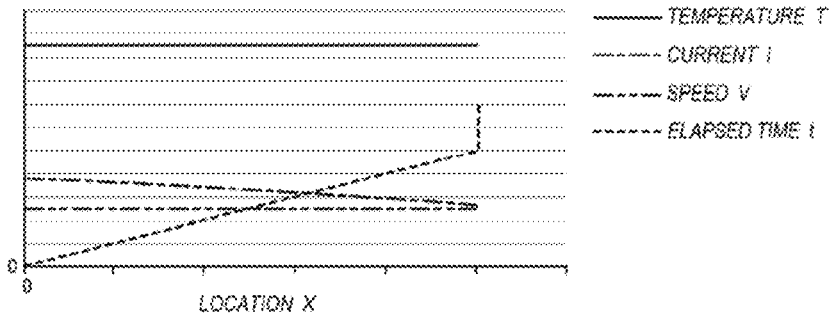
FIG. 5 is a graph showing examples of a relationship between an elapsed time from the start of heating and a position of the movable electrode, a relationship between the movement of the movable electrode and the electric current applied between the pair of electrodes, and a temperature distribution along the longitudinal direction of the workpiece at the end of the heating, according to the direct resistance heating method of FIGS. 3A and 3B.
Figure 6:
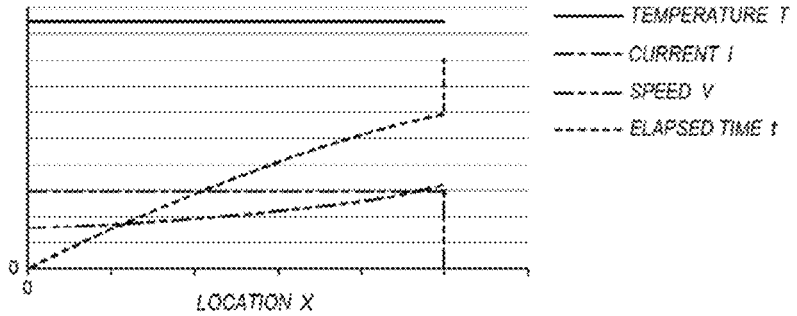
FIG. 6 is a graph showing other examples of a relationship between an elapsed time from the start of heating and a position of the movable electrode, a relationship between the movement of the movable electrode and the electric current applied between the pair of electrodes, and a temperature distribution along the longitudinal direction of the workpiece at the end of the heating, according to the direct resistance heating method of FIGS. 3A and 3B.

FIGS. 5 and 6 show examples of a relationship between an elapsed time from the start of heating and a position of the movable electrode 11, a relationship between the movement of the movable electrode 11 and the electric current applied between the pair of electrodes 10, and a temperature distribution along the longitudinal direction of the workpiece W at the end of the heating. In FIGS. 5 and 6, the position of the movable electrode 11 is expressed by a distance from the origin as the initial position (at the end portion R of the workpiece W) of the movable electrode 11 at the start of the heating.

In the example shown in FIG. 5, the movable electrode 11 is moved at a constant speed from the end portion R of the workpiece W toward the end portion L of the same, while the electric current applied between the pair of electrodes 10 is adjusted to decrease gradually. The movable electrode 11 is kept at the end portion L for a predetermined time after the movable electrode 11 reaches the end portion L, during which the same amount of electric current as that at the time when the movable electrode 11 has reached the end portion L is applied to the pair of electrodes 10. By adjusting the electric current this way, the workpiece W is heated uniformly in the longitudinal direction.

In the example shown in FIG. 6, a constant electric current is applied to the pair of electrodes 10 while the movable electrode 11 is moved from the end portion R of the workpiece W toward the end portion L of the same and the moving speed is adjusted to increase gradually. The movable electrode 11 is kept at the end portion L for a predetermined time after the movable electrode 11 reaches at the end portion L, during which the constant electric current is applied to the pair of electrodes 10. By adjusting the speed in this way, the workpiece W is heated uniformly in the longitudinal direction.

Figure 7:
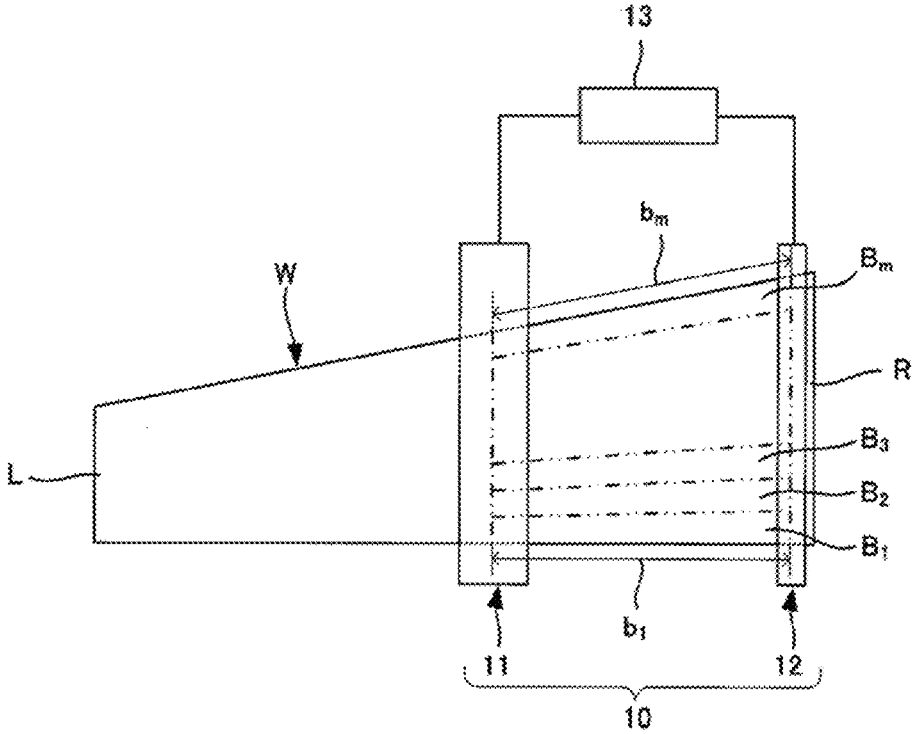
FIG. 7 is a plan view illustrating the details of the direct resistance heating method of FIGS. 3A and 3B.

FIG. 7 illustrates an example in which the heating temperature of the workpiece W is controlled in the width direction of the workpiece W. As shown in FIG. 7, the section of the workpiece W where electric current applied between the movable electrode 11 and the fixed electrode 12 during the movement of the movable electrode 11 from the end portion R of the workpiece W toward the other end portion L of the workpiece W is divided into a plurality of segment regions $B_j$ (j=1, 2, 3 . . . m) arranged side by side in the width direction of the workpiece W.

In the workpiece W whose width decreases monotonously in the moving direction of the movable electrode 11, the lengths b; of respective segment region $B_j$ (j=1, 2, 3 . . . m) between the pair of electrodes are different from one another, and electric resistances thereof are also different from one another accordingly. In the illustrated example, the length between the pair of electrodes is longer on a side of a segment region $B_m$ along one side of the workpiece W than on a side of a segment region $B_l$ along the other side of the workpiece W, and the electric resistance is also larger on the side of the segment region $B_m$ accordingly.

Figure 8:
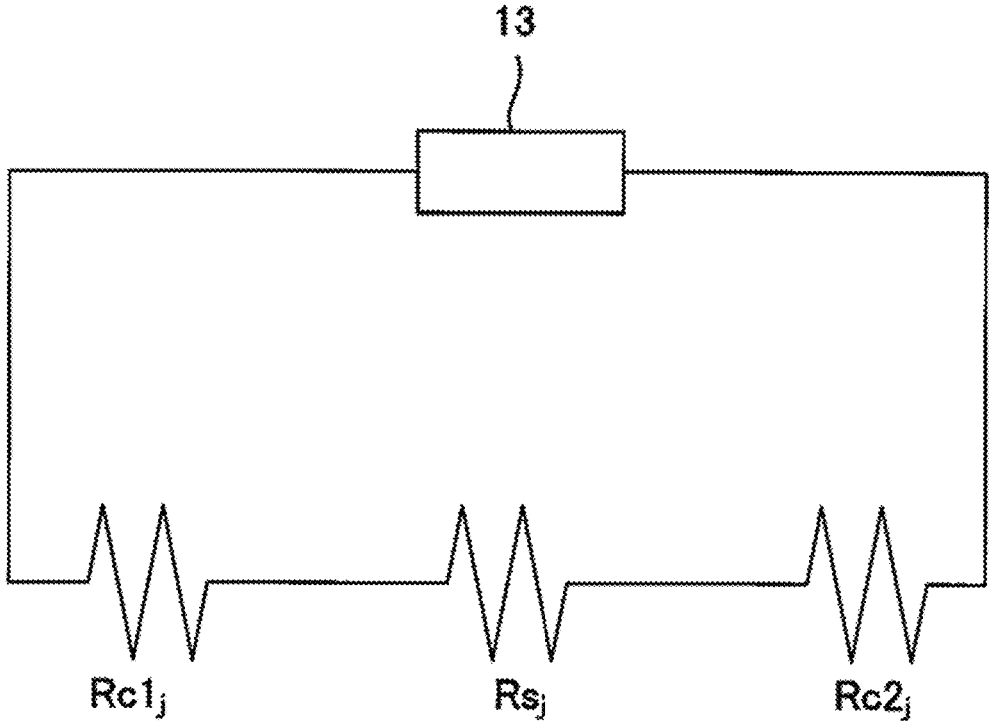
FIG. 8 is a diagram illustrating an electrically equivalent circuit of the direct resistance heating method of FIG. 7.

FIG. 8 illustrates an electrically equivalent circuit with which each segment region $B_j$ is heated by a direct resistance heating. The equivalent circuit can be expressed as a circuit in which electric resistance $Rs_j(W)$ of the workpiece in the segment region $B_j$, contact resistance $Rc\mathbf{1}_j(W)$ between the workpiece and the movable electrode 11 in the segment region $B_j$, and contact resistance $Rc\mathbf{2}_j(W)$ between the workpiece W and the fixed electrode 12 in the segment region $B_j$ are connected in series. In the example shown in FIG. 7, decide resistance Rs increases on the side of the segment region Bm.

Here, if the movable electrode 11 is in uniform contact with the workpiece W and the contact resistance is uniform as $Rc\mathbf{1}_1=Rc\mathbf{1}_2=\ldots=Rc\mathbf{1}_m$, and if the fixed electrode 12 is also in uniform contact with the workpiece W and the contact resistance is uniform as $Rc\mathbf{2}_j=Rc\mathbf{2}_2=\ldots=RC\mathbf{2}_m$, the current flowing through the segment region $B_m$ whose electric resistance Rs is relatively large is relatively small, and the amount of heat generated in the segment region $B_m$ is relatively small accordingly.

Here, each contact resistance $Rc\mathbf{1}_j$ or $Rc\mathbf{2}_j$ decreases in accordance with increase, in contact area between the workpiece W and the movable electrode 11 or the fixed electrode 12 in the segment region $B_j$. In relation to the contact pressure between the workpiece W and the movable electrode 11 or the fixed electrode 12 in the segment region $B_j$, the contact area also increases as the contact pressure increases.

Therefore, based on the relationship to the electric resistance $Rs_j$, that is, based on the relationship to the distance $b_j$ between the pair of electrodes in the segment region $B_j$, the contact pressure between the workpiece W and the movable electrode 11 or the fixed electrode 12 in the segment, region $B_j$ is adjusted to adjust the contact resistance $Rc\mathbf{1}_j$ or $Rc\mathbf{2}_j$. Thus, the amount of heat generated in the workpiece W in the segment region $B_j$ can be adjusted so that the heating temperature of the workpiece W can be controlled in the width direction of the workpiece W.

For example, when the contact, pressure between the workpiece W and the movable electrode 11 or the fixed electrode 12 on the side of the segment region $B_m$ whose electric resistance Rs is relatively large is increased, the work W can be heated uniformly in the width direction. In combination with the current adjustment shown in FIG. 5 or the speed adjustment of the movable electrode 11 shown in FIG. 6, the work W can be heated uniformly.

Test Examples will be described below.

In each Test Example, as shown in FIGS. 3A and 3B, the pair of electrodes 10 were disposed in the wide end portion R of the workpiece W, and one of the pair of electrodes 10, the electrode 11, was moved toward the narrow end portion L to heat the workpiece W uniformly along the longitudinal direction by a direct resistance heating.

Figure 9A:
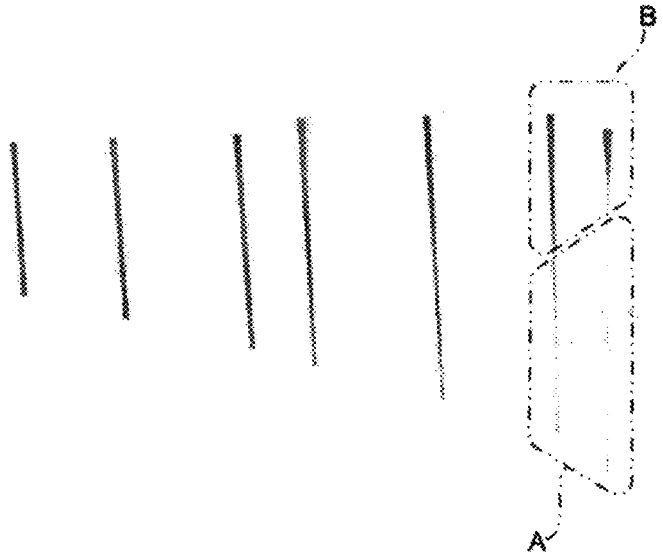
FIG. 9A is a view showing a distribution of contact pressure between a movable electrode and a workpiece in Test Example 1.
Figure 9B:
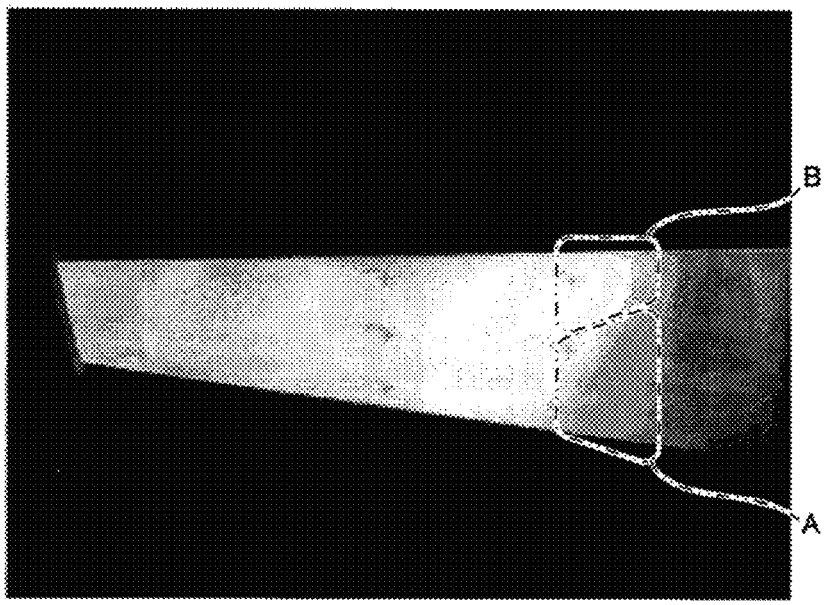
FIG. 9B is a view showing a distribution of temperature of a workpiece that has been heated by a direct resistance heating in Test Example 1.
Figure 10A:
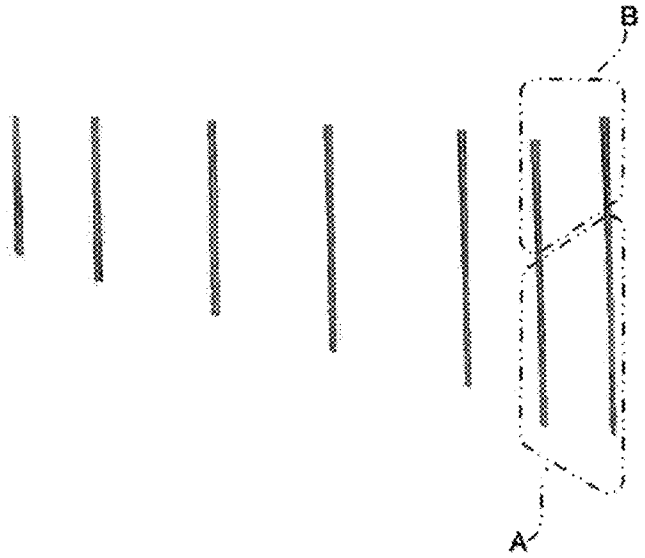
FIG. 10A is a view showing a distribution of contact pressure between a movable electrode and a workpiece in Test Example 2.
Figure 10B:
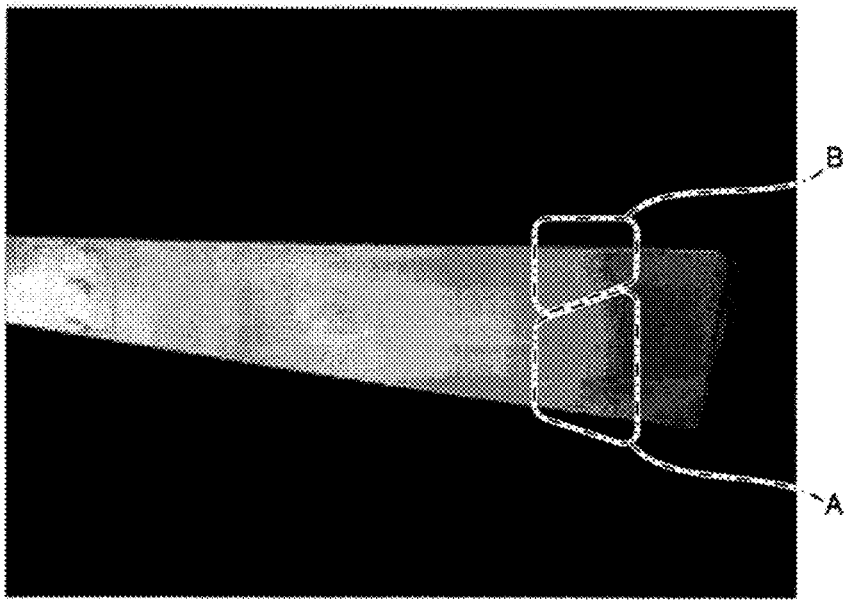
FIG. 10B is a view showing a distribution of temperature of a workpiece that has been heated by a direct resistance heating in Test Example 2.

FIG. 9A shows a distribution of contact pressure between the movable electrode 11 and the workpiece W in Test example 1 and FIG. 9B shows a distribution of temperature of the workpiece W that has been heated by a direct resistance heating in Test example 1. FIG. 10A shows a distribution of contact pressure between each portion of the movable electrode 11 and the workpiece W in Test example 2, and FIG. 10B shows a distribution of temperature of the workpiece W that has been heated by a direct resistance healing in Test example 2.

The distribution of contact pressure between the movable electrode 11 and the workpiece W was detected using pressure sensitive paper. In FIG. 9A and FIG. 10A, the distribution of contact pressure between the movable electrode 11 and the workpiece W is shown by a colored pattern of the pressure sensitive paper. In FIG. 9B and FIG. 10B, the distribution of temperature of the workpiece W is expressed by gray scale, and higher temperature is expressed by a light tone.

In Test example 1, as shown in FIG. 9A, the contact pressure between the movable electrode 11 and the workpiece W in a region A on the side of the wide end portion R of the workpiece W was too small to be detected by the pressure sensitive paper. In the distribution of temperature of the workpiece W that had been heated by a direct resistance heating, as shown in FIG. 9B, the temperature in the region A was relatively low while the temperature in a region B arranged beside the region A in the width direction of the workpiece W was relatively high.

In Test example 2, as shown in FIG. 10A, the distribution of contact pressure between the movable electrode 11 and the workpiece W was adjusted so that the contact pressure in the region A between the movable electrode 11 and the workpiece W could be made substantially equal to the contact pressure in the region B. After the workpiece W had been heated by a direct resistance heating, as shown in FIG. 10B, the variation in temperature on the side of the wide end portion R in Test example 1 was solved and equalized.

The heating method described above may be, for example, applied to hardening process based on quenching after heating, or may be applied to a method for manufacturing a press-molded article by hot press molding with pressure applied by a press mold at a high temperature state after heating. According to the aforementioned heating method, equipment for heating may have a simple configuration so that the equipment for heating can be disposed closely to a press machine or integrally built into the press machine. Accordingly, a plate workpiece can be press-molded in a short time after heating. Thus, a temperature drop in the heated plate workpiece can be suppressed to reduce an energy loss. In addition, the surface of the plate workpiece can be prevented from being oxidized, so that a high-quality press-molded article can be manufactured.

This application is based on Japanese Patent Application No. 2015-043557 filed on Mar. 5, 2015, the entire content of which is incorporated herein by reference.

The invention claimed is:

1. A heating method comprising:

placing a pair of electrodes on a workpiece along a first direction, the pair of electrodes having a length extending across a heating target region of the workpiece in the first direction;

moving at least one of the electrodes in a second direction perpendicular to the first direction over the heating target region while applying electric current to the pair of electrodes, to heat the heating target region by a direct resistance heating; and adjusting a distribution of contact pressure between at least one of the electrodes and the workpiece along the first direction, with a plurality of segment regions being defined by dividing the heating target region such that the segment regions are arranged side by side in the first direction, and in accordance with a length of each of the segment regions between the pair of electrodes, to adjust a heating temperature of each of the segment regions of the heating target region.

2. The heating method according to claim 1, wherein the segment regions include a long segment region and a short segment region, the length of the long segment region between the pair of electrodes being longer than the length of the short segment region between the pair of electrodes, and wherein the contact pressure is adjusted to be higher in the long segment region than in the short segment region.

3. The heating method according to claim 2, wherein a dimension of the heating target region in the first direction varies along the second direction.

4. The heating method according to claim 1, wherein a dimension of the heating target region in the first direction varies along the second direction.

5. The heating method according to claim 4, wherein the dimension of the heating target region in the first direction decreases monotonously along the second direction.

6. A heating apparatus comprising:

a pair of electrodes arranged to extend across a heating target region of a workpiece in a first direction;

a power supply unit configured to supply electric current to the pair of electrodes;

a moving section configured to move at least one of the electrodes in a second direction perpendicular to the first direction over the heating target region;

a presser configured to press at least one of the electrodes against the workpiece such that a distribution of contact pressure against the workpiece along the first direction is adjustable; and a control unit configured to control the presser, with a plurality of segment regions being defined by dividing the heating target region such that the segment regions arranged side by side in the first direction, and in accordance with a length of each of the segment regions between the pair of electrodes, to adjust the distribution of the contact pressure along the first direction.

7. The heating apparatus according to claim 6, wherein the segment regions include a long segment region and a short segment region, the length of the long segment region between the pair of electrodes being longer than the length of the short segment region between the pair of electrodes, and wherein the control unit adjusts the contact pressure to be higher in the long segment region than in the short segment region.

8. The heating apparatus according to claim 6, wherein the presser comprises a plurality of pressing elements provided at intervals in the first direction so as to be operated independently of one another.

9. A method for manufacturing a press-molded article, the method comprising:

heating a plate workpiece, and applying pressure to the plate workpiece with a press mold to perform hot press molding on the plate workpiece, wherein the heating comprises:

placing a pair of electrodes on the plate workpiece along a first direction, the pair of electrodes having a length extending across a heating target region of the plate workpiece in the first direction;

moving at least one of the electrodes in a second direction perpendicular to the first direction over the heating target region while applying electric current to the pair of electrodes, to heat the heating target region by a direct resistance heating; and adjusting a distribution of contact pressure between at least one of the electrodes and the plate workpiece along the first direction, with a plurality of segment regions being defined by dividing the heating target region such that the segment regions are arranged side by side in the first direction and in accordance with a length of each of the segment regions between the pair of electrodes, to adjust a heating temperature of each of the segment regions of the heating target region.

10. The heating apparatus according to claim 7, wherein the presser comprises a plurality of pressing elements provided at intervals in the first direction so as to be operated independently of one another.

* * * * *